US006318277B1

(12) United States Patent
Kokkinos

(10) Patent No.: US 6,318,277 B1
(45) Date of Patent: Nov. 20, 2001

(54) METHOD FOR REDUCING NOX EMISSIONS WITH MINIMAL INCREASES IN UNBURNED CARBON AND WATERWALL CORROSION

(75) Inventor: Angelos Kokkinos, Hudson, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/394,163

(22) Filed: Sep. 13, 1999

(51) Int. Cl.[7] ..... F23B 5/00; F23B 7/00

(52) U.S. Cl. ..... 110/345; 110/214; 110/343; 110/344; 110/297; 110/210

(58) Field of Search ..... 110/213, 343, 110/344, 345, 210, 211, 212, 214, 205, 297, 314

(56) References Cited

U.S. PATENT DOCUMENTS

| | | | | |
|---|---|---|---|---|
| 4,651,653 | * | 3/1987 | Anderson et al. | 110/234 |
| 4,672,900 | * | 6/1987 | Santalla et al. | 110/264 |
| 5,195,450 | * | 3/1993 | Marion | 110/347 |
| 5,315,939 | * | 5/1994 | Rini et al. | 110/264 |
| 5,488,916 | * | 2/1996 | Bozzuto | 110/347 |
| 5,626,085 | * | 5/1997 | Donais | 110/188 |
| 5,809,913 | * | 9/1998 | Kramer et al. | 110/347 |
| 5,908,003 | * | 6/1999 | Hura et al. | 110/345 |
| 5,915,310 | * | 6/1999 | Hura et al. | 110/345 |
| 5,992,337 | * | 11/1999 | Phillipe et al. | 110/348 |
| 6,058,855 | * | 5/2000 | Ake et al. | 110/214 |
| 6,192,811 | * | 2/2001 | Vatsky | 110/297 |

* cited by examiner

*Primary Examiner*—Henry Bennett
*Assistant Examiner*—K. B. Rinehart
(74) *Attorney, Agent, or Firm*—Eric Marich

(57) ABSTRACT

A method and apparatus for reducing NOx emissions in a furnace having a main combustion zone with a waterwall and apparatus for supplying main combustion air and fuel to the main combustion zone, also reduces unburned carbon and waterwall corrosion in the furnace. The method involves providing at least one lower overfire air injector at a first level over the main combustion zone of the furnace for supplying overfire air to create a lower overfire air zone in the furnace over the main combustion zone and at least one upper overfire air injector at a second level over the lower overfire zone for supplying overfire air to create an upper overfire air zone in the furnace over the lower overfire zone. The overfire air in the lower and upper overfire air zones are supplied at a rate for reducing the stoichiometry in the main combustion zone which reduces unburned carbon and a corrosive reducing atmosphere in the furnace.

5 Claims, 1 Drawing Sheet

METHOD FOR REDUCING NOX EMISSIONS WITH MINIMAL INCREASES IN UNBURNED CARBON AND WATERWALL CORROSION

FIELD AND BACKGROUND OF THE INVENTION

1. Field of the Invention

The present invention relates in general to a technique and apparatus for reducing NOx emissions, and in particular to a new and useful method and apparatus for reducing nitrogen oxide emissions without increasing the presence of unburned carbon and without causing conditions in the furnace which increase corrosion.

2. Description of the Related Art

There are many papers and patents that describe the use of staged combustion for controlling NOx emissions during the combustion of pulverized coal.

In a tangentially fired furnace, pulverized coal and the required air for combustion are introduced at the furnace corners tangent to an imaginary circle in the middle of the furnace. Controlling the emissions of nitric oxides (NOx) from these furnaces is accomplished through the use of staging, that is, the introduction of some of the combustion air downstream of the fuel for the purpose of allowing nitrogenous compounds from the fuel to convert to molecular nitrogen rather than to nitric oxide (NOx). The combustion air that has been used to accomplish this is called overfire air since it is introduced above the main combustion zone. This method of controlling NOx emissions has been very effective. However, it results in increased levels of unburned carbon due to the inefficiency of the combustion process and corrosion of the furnace's heat absorption surfaces due to the reducing (lack of oxygen) atmospheres required for the control of NOx emissions.

SUMMARY OF THE INVENTION

The present invention includes a system for tangentially-fired units where a portion of the combustion air is injected above the main combustion zone causing the stoichiometry of the combustion zone to be less than 1.0. The air injected above the main combustion zone, called overfire air (OFA), is introduced into the furnace at two different locations (elevations). The first elevation is located as close to the main combustion zone as possible. This air is also introduced through multiple locations at the same horizontal plane. Air injectors of the invention are designed such that they can be yawed horizontally and vertically to allow for adequate mixing with main combustion product gases. The amount of air injected through this lower OFA location represents 15 to 40% of the total amount of OFA, with the actual amount depending on the overall stoichiometry required for NOx emissions reduction and the chemical properties of the coal.

The upper OFA injection ports are located above the lower ports and allow the combustion gases a residence time of 0.1 to 0.2 seconds prior to mixing with the air injected by the upper OFA ports. The upper OFA ports can be multiple locations in the same horizontal plane. The amount of air introduced through these ports is enough to complete the combustion process.

Controlling NOx emissions in tangentially fired boilers when combusting pulverized coal through the use of air staging results, as noted, in operating the main combustion zone under substoichiometric conditions achieved by the invention. These conditions result in the creation of a reducing atmosphere creating gases that promote corrosion of the furnace's heat absorption surfaces. The corrosion of the furnace heat absorption surfaces is most severe in the area of the highest heat release rates and lowest stoichiometry, which is immediately above the main burner zone (i.e., the main area where the combustion air and fuel are introduced). It is this area that the lower level of OFA is located. The introduction of this air at several locations at this elevation allows for a protective layer of oxidizing atmosphere to be formed, preventing gases, such as $H_2S$ and CO, that are major contributors to corrosion.

The introduction of this lower OFA at those locations under the conditions described according to this invention also reduces corrosion created through the direct deposition of corrosion inducing solids. Under this mechanism, ash particles containing corrosion promoting constituents will deposit and directly attack the heating surfaces. The oxygen contained in the air introduced through these lower OFA ports oxidizes these compounds resulting in reduced corrosion rates.

The use of substoichiometric conditions in the main combustion zone also produces an increase in combustible losses due to the inefficient mixing of fuel and combustion air. The use of multiple ports at the lower and upper OFA locations allows for more complete mixing, thereby reducing levels of unburned combustibles and improving boiler efficiency. The use of the multiple elevations of OFA also allows for maintaining significant reduction of NOx emissions.

Accordingly, an object of the present invention is to provide a method of reducing NOx emissions in a furnace having a main combustion zone with a waterwall and means for supplying main combustion air and fuel to the main combustion zone, the method reducing unburned carbon and waterwall corrosion in the furnace, the method comprising providing at least one lower overfire air injector at a first level over the main combustion zone of the furnace for supplying overfire air to create a lower overfire air zone in the furnace over the main combustion zone and providing at least one upper overfire air injector at a second level over the lower overfire air zone for supplying overfire air to create an upper overfire air zone in the furnace over the lower overfire air zone. The overfire air in the lower and upper overfire air zones are supplied at a rate for reducing the stoichiometry in the main combustion zone which reduces unburned carbon and a corrosive reducing atmosphere in the furnace.

A further object of the present invention is to provide an apparatus for achieving the same effect.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
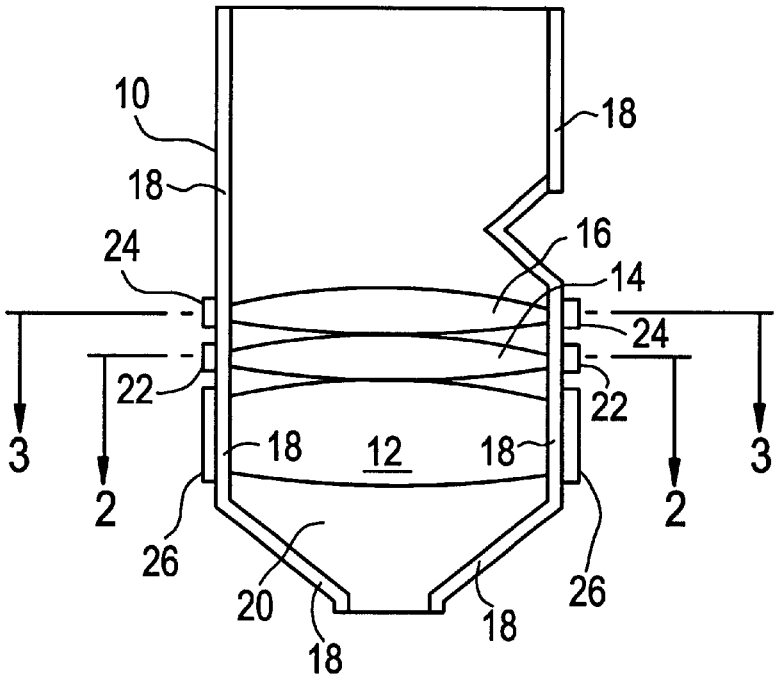
FIG. 1 is a schematic side elevation sectional view of a furnace, operated in accordance with the present invention.
Figure 2:
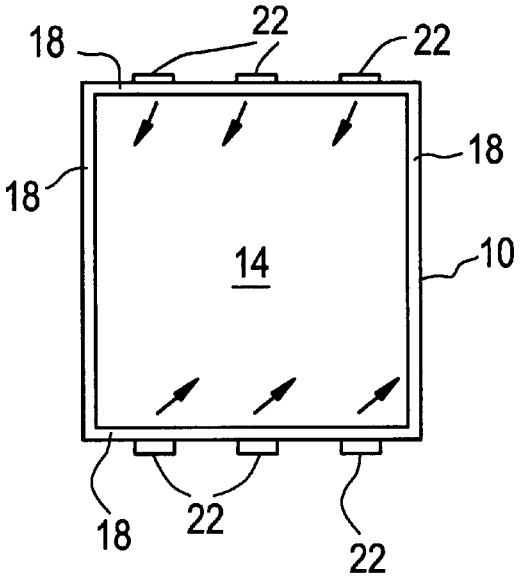
FIG. 2 is a horizontal sectional view, taken along line 2—2 of FIG. 1.

Referring to the drawings generally, wherein like reference numerals designate the same or functionally similar elements, and to FIG. 1 in particular, the invention embodied in FIG. 1 is a method and apparatus for reducing NOx emissions in a furnace while, at the same time, reducing the occurrence of unburned carbon and conditions causing corrosion of the waterwall in the furnace. Furnace 10 in FIG. 1 includes a housing containing various combustion zones defined by walls 18, advantageously water-cooled membrane walls or waterwalls 18, including a main combustion zone 12 which is above and forms part of a hopper 20. Numerals 26, 26 identify means for supplying main combustion air and fuel to the main combustion zone 12 for igniting the fuel. At a first vertical level in the furnace 10, designated by line 2—2, a lower overfire zone is defined by at least one, but preferably a plurality of lower overfire air injectors 22, 22. This produces a lower overfire zone 14. A second upper overfire zone 16 is defined above zone 14 and by at least one, but preferably a plurality of upper overfire air injectors 24, 24. As shown in FIG. 2, lower overfire air injectors 22 in the lower overfire air zone 14 are articulated so that they can be pivoted in any desired direction to improve the conditions sought. FIG. 2 illustrates angling of the injectors 22 to produce an oxygen rich environment along the walls 18 in lower overfire air zone 14.

Figure 3:
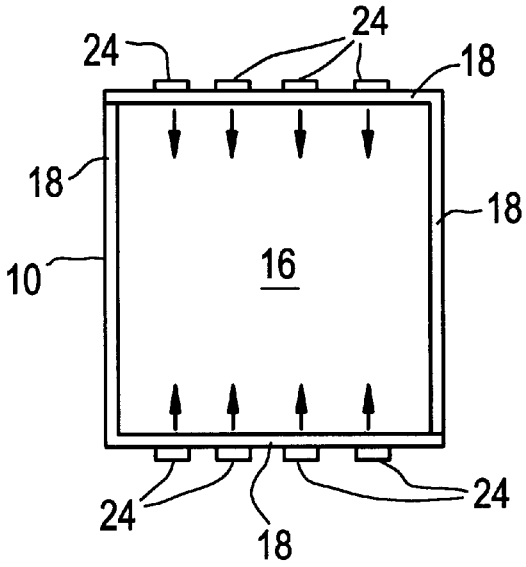
FIG. 3 is a horizontal sectional view, taken along line 3—3 of FIG. 1.

FIG. 3 illustrates the injectors 24 in the upper zone 16. Although plural injectors on opposite walls 18 are shown, injectors on all four walls 18 can be utilized or injectors only at the corners of the walls 18 in FIG. 3 can be utilized.

The multiple nozzles in FIG. 2, likewise, can be provided for on all four walls 18, or only on the opposite walls 18 as shown or, in an extreme case, a single injector can be provided in each of the upper and lower levels on a single wall 18.

The amount of overfire air provided in the lower level 14 through nozzles 22 is selected to be 15% to 40% of the total amount of OFA required to modify the stoichiometry in the main combustion zone 12 to be about 0.7 to about 1.0, depending upon the degree of NOx emission reduction required. This is also done without increasing unburned carbon, nor producing a reducing atmosphere which causes corrosion on the waterwall 18 in the furnace.

Overfire air is provided in the upper zone 16 through injectors 24 to allow the combustion gases a residence time of about 0.1 to about 0.2 seconds prior to mixing with the injected air from the upper ports.

While a specific embodiment of the invention has been shown and described in detail to illustrate the application of the principles of the invention, it will be understood that the invention may be embodied otherwise without departing from such principles.

I claim:

1. A method of reducing NOx emissions in a furnace having a main combustion zone with a waterwall and means for supplying main combustion air and fuel to the main combustion zone, the method reducing unburned carbon and waterwall corrosion in the furnace, the method comprising:

providing at least one lower overfire air injector at a first level over the main combustion zone of the furnace for supplying overfire air to create a lower overfire air zone in the furnace over the main combustion zone;

providing at least one upper overfire air injector at a second level over the lower overfire air zone for supplying overfire air to create an upper overfire air zone in the furnace over the lower overfire air zone; and supplying the overfire air in the lower overfire air zone at a rate to produce a stoichiometry of 0.7 to 1.0 in the main combustion zone and providing overfire air in the upper overfire air zone at a location to permit combustion gases from the lower overfire air zone to be resident for about 0.1 to 0.2 seconds prior to being mixed with overfire air from the upper overfire air injector to reduce unburned carbon and a corrosive reducing atmosphere in the furnace.

2. The method according to claim 1, including providing a plurality of lower overfire air injectors at the first level.

3. The method according to claim 2, including articulating the lower overfire air injectors for directing overfire air at this first level in a selected pattern.

4. The method according to claim 3, including providing a plurality of lower overfire air injectors.

5. An apparatus for reducing NOx emissions in a furnace having a main combustion zone with a waterwall and means for supplying main combustion air and fuel to the main combustion zone, and which reduces unburned carbon and waterwall corrosion in the furnace, the apparatus comprising:

a plurality of lower overfire air injectors at a first level over the main combustion zone of the furnace for supplying overfire air to create a lower overfire air zone in the furnace over the main combustion zone;

means for articulating the plurality of lower overfire air injectors for directing the overfire air at the first level to produce an oxygen rich environment along the waterwalls in the lower overfire air zone;

a plurality of upper overfire air injectors at a second level over the lower overfire air zone for supplying overfire air to create an upper overfire air zone in the furnace over the lower overfire air zone; and means for supplying the overfire air in the lower overfire air zone at a rate to produce a stoichiometry of 0.7 to 1.0 in the main combustion zone, and for providing overfire air in the upper overfire air zone at a location to permit combustion gases from the lower zone to be resident for about 0.1 to 0.2 seconds prior to being mixed with overfire air from the upper overfire air injector for reducing the stoichiometry in the main combustion zone which reduces unburned carbon and a corrosive reducing atmosphere in the furnace.

* * * * *